US008981739B2

(12) United States Patent
Zhang et al.

(10) Patent No.: US 8,981,739 B2
(45) Date of Patent: Mar. 17, 2015

(54) LOW POWER LOW DROPOUT LINEAR VOLTAGE REGULATOR

(71) Applicant: Nxp B.V., Eindhoven (NL)

(72) Inventors: Junmou Zhang, Tempe, AZ (US); Jim Caravella, Tempe, AZ (US); Brad Gunter, Tempe, AZ (US)

(73) Assignee: NXP B.V., Eindhoven (NL)

( * ) Notice: Subject to any disclaimer, the term of this patent is extended or adjusted under 35 U.S.C. 154(b) by 244 days.

(21) Appl. No.: 13/627,917

(22) Filed: Sep. 26, 2012

(65) Prior Publication Data

US 2014/0084896 A1 Mar. 27, 2014

(51) Int. Cl.

| | |
|---|---|
| ***G05F 1/10*** | (2006.01) |
| ***G05F 1/56*** | (2006.01) |
| ***G05F 1/575*** | (2006.01) |
| ***G05F 1/577*** | (2006.01) |

(52) U.S. Cl.

CPC *G05F 1/56* (2013.01); *G05F 1/575* (2013.01); *G05F 1/577* (2013.01)

USPC ..... 323/266; 327/536

(58) Field of Classification Search

USPC ..... 323/222, 266–268, 273, 276, 280, 323/282–288; 327/156, 158, 536, 537, 541, 327/563

See application file for complete search history.

(56) References Cited

U.S. PATENT DOCUMENTS

| | | | | | |
|---|---|---|---|---|---|
| 5,162,668 | A * | 11/1992 | Chen et al. | ..... | 327/541 |
| 5,850,139 | A * | 12/1998 | Edwards | ..... | 323/280 |
| 5,912,550 | A * | 6/1999 | Sharpe-Geisler | ..... | 323/273 |
| 7,550,954 | B2 * | 6/2009 | De Nisi et al. | ..... | 323/266 |
| 7,764,525 | B2 * | 7/2010 | Hsieh et al. | ..... | 363/60 |
| 7,821,328 | B2 * | 10/2010 | Hoque et al. | ..... | 327/536 |
| 8,159,797 | B2 * | 4/2012 | Tamegai | ..... | 361/91.1 |
| 8,760,133 | B2 * | 6/2014 | Hasegawa et al. | ..... | 323/280 |
| 2009/0103219 | A1 | 4/2009 | Tamegai | | |
| 2009/0115382 | A1 | 5/2009 | Hasegawa et al. | | |
| 2009/0237046 | A1 | 9/2009 | Hsieh et al. | | |
| 2009/0278515 | A1 * | 11/2009 | Broussard et al. | ..... | 323/267 |

OTHER PUBLICATIONS

Extended European Search Report (EESR Application No. 13177303.8). European Patent Office. Feb. 27, 2014. pp. 9.

* cited by examiner

*Primary Examiner* — Rajnikant Patel

(57) ABSTRACT

Embodiments of a linear voltage regulator are described. In one embodiment, the linear voltage regulator includes a PMOS low drop-out (LDO) regulator configured to convert an input voltage to a regulated voltage, a charge pump connected to the PMOS LDO regulator and configured to amplify the regulated voltage into an amplified voltage, and an NMOS LDO regulator connected to the charge pump and configured to convert the amplified voltage into an output voltage. Other embodiments are also described.

20 Claims, 5 Drawing Sheets

LOW POWER LOW DROPOUT LINEAR VOLTAGE REGULATOR

The need for efficient power management in battery operated consumer products, such as smartphones, tablet computers, laptops, has driven voltage regulators to be integrated with logic circuits in the same device. In some cases, a semiconductor device can be divided into multiple voltage islands. Each voltage island is powered by a dedicated voltage regulator and the power supply of each voltage island is scaled according to the timing requirement of the voltage island or a specific voltage requirement of a component. A linear voltage regulator, such as a low drop-out (LDO) regulator, is a good candidate to regulate the voltage of each voltage island because its small size and linear regulation make it easier to integrate with a logic circuit in the same integrated circuit (IC) die. In addition, a linear voltage regulator can be used to insulate sensitive analog blocks from power supply noise. These sensitive analog blocks usually are placed side by side with digital circuits or dc-dc converters that generate noise with amplitudes on the order of hundreds of millivolts and frequency components in the range of tens of kilohertz to hundreds of megahertz. The performance of sensitive analog blocks deteriorates with increased noise. For example, noise can cause large jitter for a phase lock loop circuit and can decrease the accuracy of a temperature sensor. Because low power applications demand that sensitive analog blocks consume a low current, the sensitive analog blocks are even more susceptible to noise. Consequently, designing an adequate linear regulator is crucial for the overall performance of a semiconductor device.

The critical design parameters of a linear regulator include, for example, the ground current, which is the current consumed by the linear regulator itself, the dropout voltage, which is the voltage drop across the linear regulator, and the power supply rejection (PSR) ratio. Specifically, a linear regulator for regulating the voltage for a digital circuit needs to have a low ground current and a low dropout voltage. In addition to a low ground current and a low dropout voltage, a linear regulator for regulating the voltage for an analog circuit also needs to have a high PSR ratio. Therefore, there is a need for a low current consumption linear regulator that exhibits a low dropout voltage for digital circuits and exhibits a high PSR ratio and a low dropout voltage for analog circuits.

Embodiments of a linear voltage regulator are described. In one embodiment, the linear voltage regulator includes a PMOS LDO regulator configured to convert an input voltage to a regulated voltage, a charge pump connected to the PMOS LDO regulator and configured to amplify the regulated voltage into an amplified voltage, and an NMOS LDO regulator connected to the charge pump and configured to convert the amplified voltage into an output voltage. Other embodiments are also described.

In an embodiment, a linear voltage regulator includes a PMOS LDO regulator configured to convert an input voltage to a regulated voltage, an one-stage charge pump connected to the PMOS LDO regulator and configured to amplify the regulated voltage into an amplified voltage that doubles the regulated voltage, and an NMOS LDO regulator connected to the one-stage charge pump and configured to convert the amplified voltage into an output voltage. The PMOS LDO regulator includes a PMOS power transistor from which the regulated voltage is output to the one-stage charge pump and a variable resistance transistor having a gate terminal that is connected to a gate terminal of the PMOS power transistor. The NMOS LDO regulator includes an operational amplifier (OPAMP) configured to receive the amplified voltage; and an NMOS power transistor having a gate terminal that is connected to the OPAMP, wherein the output voltage is output from the NMOS power transistor.

In an embodiment, a linear voltage regulator includes a PMOS LDO regulator configured to convert an input voltage to a regulated voltage, a charge pump connected to the PMOS LDO regulator and configured to amplify the regulated voltage into an amplified voltage, and an NMOS LDO regulator connected to the charge pump and configured to convert the amplified voltage into a first output voltage and a second output voltage. The PMOS LDO regulator includes a PMOS power transistor from which the regulated voltage is output to the charge pump, a variable resistance transistor having a gate terminal that is connected to a gate terminal of the PMOS power transistor, and a capacitor connected in parallel with the variable resistance transistor. The NMOS LDO regulator includes an OPAMP configured to receive the amplified voltage, a first NMOS power transistor having a gate terminal that is connected to the OPAMP, and a second NMOS power transistor having a gate terminal that is connected to the OPAMP and the gate terminal of the first NMOS power transistor. The first output voltage is output from the first NMOS power transistor and the second output voltage is output from the second NMOS power transistor.

Other aspects and advantages of embodiments of the present invention will become apparent from the following detailed description, taken in conjunction with the accompanying drawings, depicted by way of example of the principles of the invention.

Throughout the description, similar reference numbers may be used to identify similar elements.

It will be readily understood that the components of the embodiments as generally described herein and illustrated in the appended figures could be arranged and designed in a wide variety of different configurations. Thus, the following detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment. Rather, language referring to the features and advantages is understood to mean that a specific feature, advantage, or characteristic described in connection with an embodiment is included in at least one embodiment. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment. Thus, the phrases "in one embodiment," "in an embodiment," and similar language throughout this specification may, but do not necessarily, all refer to the same embodiment.

Figure 1:
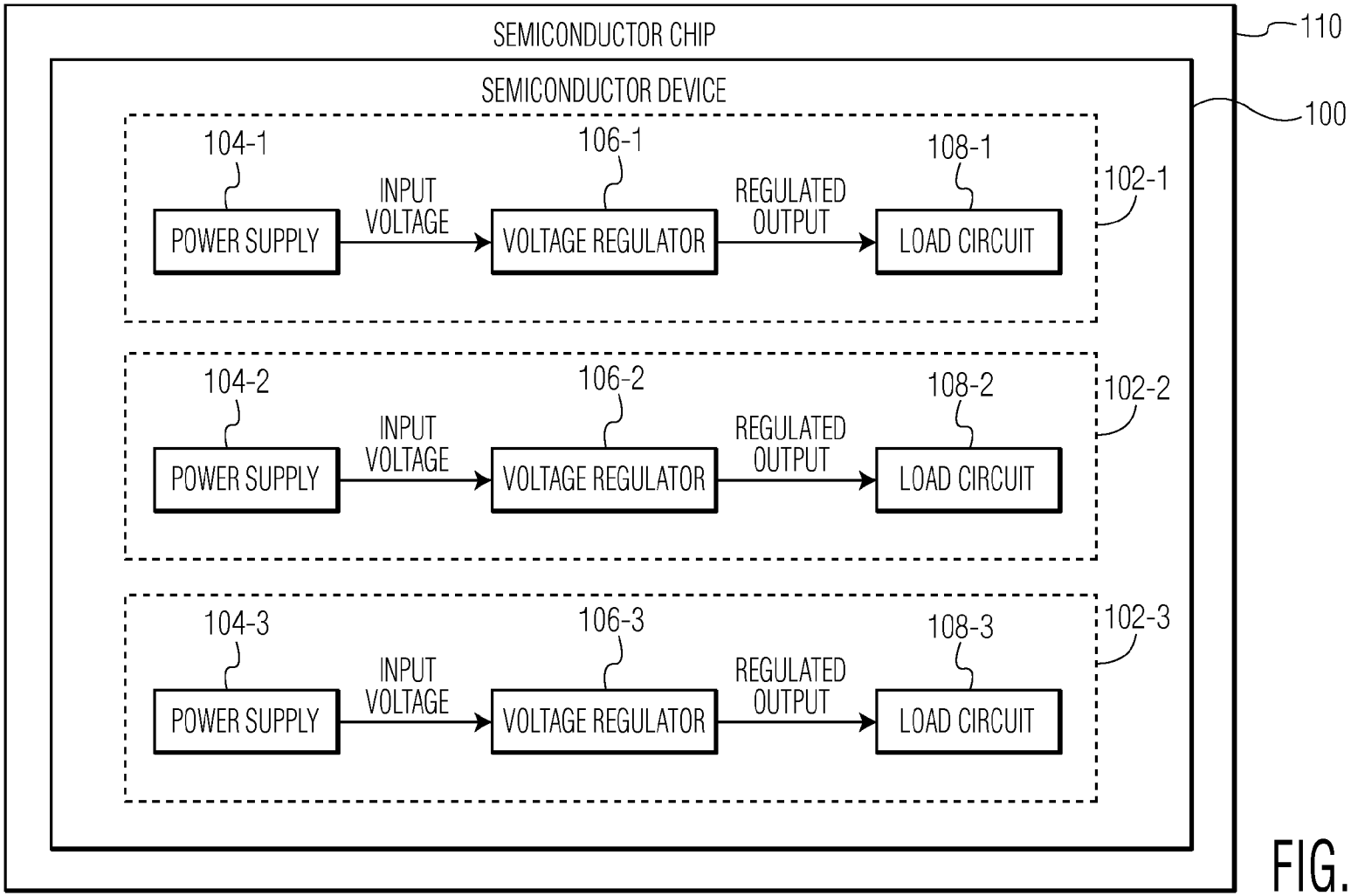
FIG. 1 is a schematic block diagram of a semiconductor device in accordance with an embodiment of the invention.

FIG. 1 is a schematic block diagram of a semiconductor device 100 in accordance with an embodiment of the invention. The semiconductor device may be a semiconductor circuit, such as, an analog circuit or a digital circuit. In the embodiment depicted in FIG. 1, the semiconductor device includes power supplies 104-1, 104-2, 104-3, voltage regulators 106-1, 106-2, 106-3, and load circuits 108-1, 108-2, 108-3, which are located in three respective voltage domains 102-1, 102-2, 102-3. The semiconductor device can be implemented in a substrate, such as a semiconductor wafer or a printed circuit board (PCB). In an embodiment, the semiconductor device is packaged in a semiconductor IC chip 110 and included in a computing device, such as a smartphone, a tablet computer, a laptop, etc.

Each of the voltage domains 102-1, 102-2, 102-3 has a dedicated voltage regulator 106-1, 106-2, or 106-3. In each of the voltage domains, the power supply 104-1, 104-2, or 104-3 is configured according to the timing requirement or specific component voltage requirement in that particular voltage domain.

In the three voltage domains 102-1, 102-2, 102-3, each of the power supplies 104-1, 104-2, 104-3 is configured to generate at least one input voltage for the corresponding voltage regulator 106-1, 106-2, or 106-3. The power supplies may include any type of power supply. In an embodiment, at least one of the power supplies is a battery power supply or other type of power supply that can supply a limited amount of power. The battery power supply may be a battery having a limited useful lifetime. For example, the battery power supply may be a lithium battery or any other type of battery. In another embodiment, at least one of the power supplies is a plugged-in power supply or other type of power supply that can supply an effectively endless amount of power. In an embodiment, instead of including the power supplies, the semiconductor device 100 includes interfaces to the power supplies. In another embodiment, the power supplies may represent power supply interfaces.

Each of the voltage regulators 106-1, 106-2, 106-3 converts an input voltage from a corresponding power supply 104-1, 104-2, or 104-3 to a desired regulated output, such as a regulated output voltage. At least one voltage reference circuit can be used by itself or in conjunction with the power supplies 104-1, 104-2, 104-3 to generate input voltages for the voltage regulators 106-1, 106-2, 106-3. In one embodiment, each of the voltage regulators 106-1, 106-2, 106-3 operates independent from each other. Each of the voltage regulators 106-1, 106-2, 106-3 may include a power element and a regulator controller. In one embodiment, each of the voltage regulators 106-1, 106-2, 106-3 generates a different regulated voltage.

In the three voltage domains 102-1, 102-2, 102-3, the load circuits 108-1, 108-2, 108-3 can be any type of electrical load. For example, the load circuits may include a capacitive load, a resistive load, and/or an inductive load. In an embodiment, the load circuits require uninterrupted power with fixed voltages from the voltage regulators 106-1, 106-2, 106-3. For example, the load circuits may include a real-time clock circuit that performs essential time keeping functions or a volatile memory circuit that contains unique or critical data.

Although the semiconductor device 100 is show in FIG. 1 as including three voltage domains 102-1, 102-2, 102-3, in some other embodiments, the semiconductor device may include more than three voltage domains or less than three voltage domains. For example, in one embodiment, the semiconductor device has only one voltage domain. In this embodiment, the semiconductor device may include only one power supply 104, only one voltage regulator 106, and only one load circuit 108.

Figure 2:
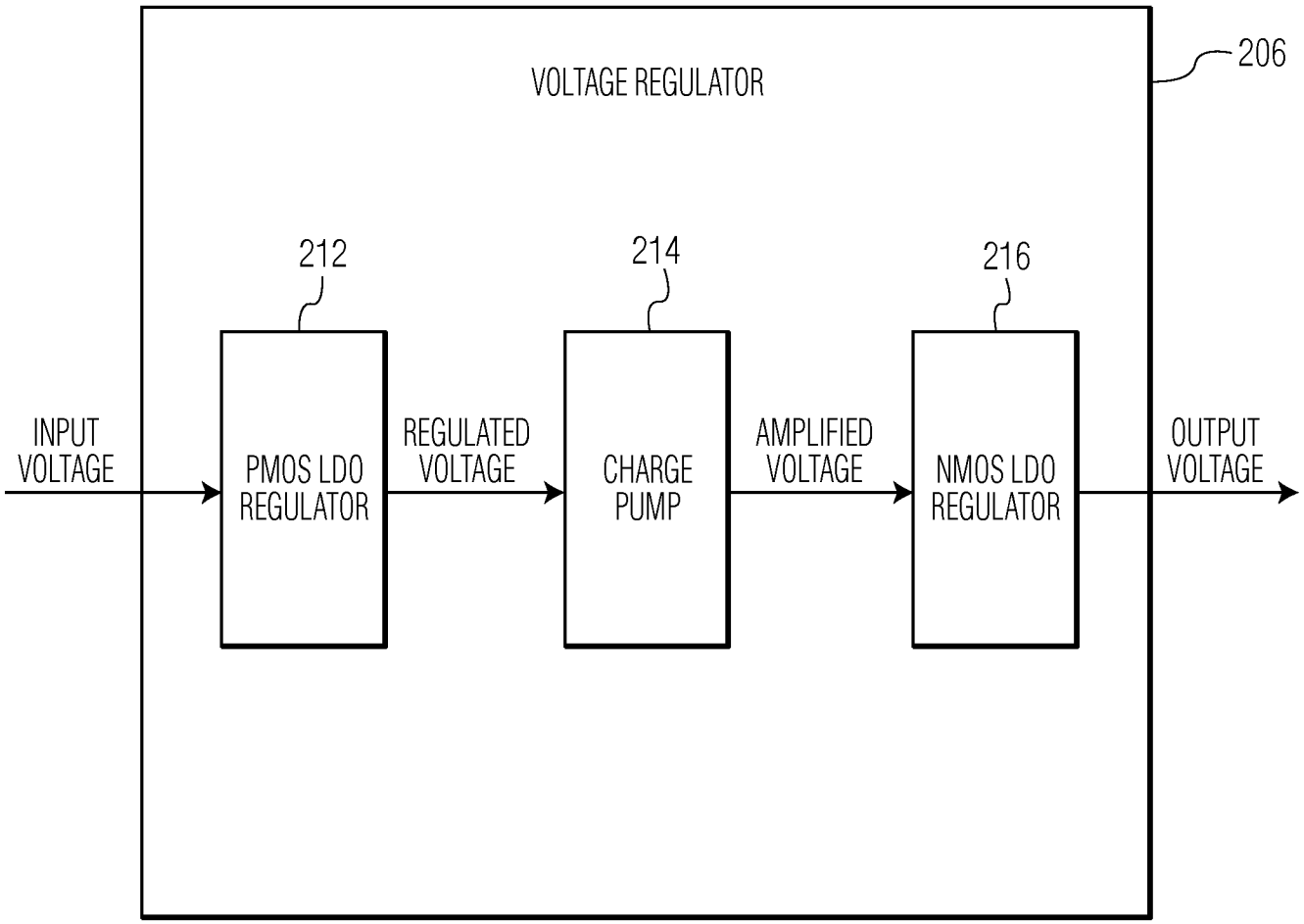
FIG. 2 is a block diagram of a voltage regulator in accordance with an embodiment of the invention.

Turning now to FIG. 2, components of a voltage regulator 206, which is representative of the voltage regulators 106-1, 106-2, 106-3, are shown. The voltage regulator 206 is a linear voltage regulator that maintains a constant output voltage. In contrast to a switching regulator, the resistance of a linear voltage regulator varies in accordance with the load to maintain the constant output voltage.

One possible implementation of a linear voltage regulator utilizes an NMOS power transistor. However, the disadvantage of a NMOS-based linear regulator is that a large dropout voltage is required because the gate voltage of the NMOS power transistor needs to be a threshold voltage higher than the regulated voltage. Another possible implementation of a linear voltage regulator utilizes a PMOS power transistor. Compared to an NMOS-based linear regulator, a PMOS-based linear regulator has a lower dropout voltage. However, a PMOS-based linear regulator typically utilizes a capacitor with a large capacitance at the output of the regulator for load stabilization. Due to the large capacitor, the frequency domain dominant pole of the PMOS-based linear regulator is located at the output node. However, the location of this dominant pole increases with the current load, which can lead to voltage regulation instability. One solution for the stability issue of a PMOS-based linear regulator is to utilize an equivalent serial resistor (ESR) of the capacitor. However, the ESR slows down the transient response to a changing load and requires additional power consumption. In addition, the ESR is hard to control and can vary significantly between different capacitors and can incur additional design and manufacturing costs.

In the embodiment depicted in FIG. 2, the voltage regulator 206 includes a PMOS low drop-out (LDO) regulator 212 configured to convert an input voltage to a regulated voltage, a charge pump 214 connected to the PMOS LDO regulator 212 and configured to amplify the regulated voltage into an amplified voltage, and an NMOS LDO regulator 216 connected to the charge pump 214 and configured to convert the amplified voltage into an output voltage. In one embodiment, the PMOS LDO regulator 212 and the NMOS LDO regulator 216 are connected to a power supply voltage and to a lower voltage, such as, ground. The voltage regulator 206 can generate a regulated voltage that ranges from lower than one volt to tens of volts. In the voltage regulator 206, the PMOS LDO regulator 212 is used to achieve a low dropout voltage for the charge pump 214, the charge pump 214 is used to provide a high input voltage for the NMOS LDO regulator 216 such that a low or zero dropout voltage can be achieved for the NMOS LDO regulator 216, and the NMOS LDO regulator 216 is used to minimize the requirement of a large capacitance at the output and to maintain the feedback loop stability of the voltage regulator 206. Consequently, the voltage regulator 206 can generate a stable low or zero dropout output voltage that is suitable for digital circuits and for analog circuits.

The PMOS LDO regulator 212 is used to generate a regulated voltage, which is output to the charge pump 214. In an embodiment, the PMOS LDO regulator 212 includes a PMOS power transistor from which the regulated voltage is output to the charge pump 214 and a variable resistance transistor having a gate terminal that is connected to a gate terminal of the PMOS power transistor. The variable resistance transistor may have a resistance that is controlled by a voltage at the gate terminal of the variable resistance transistor. Because the gate voltage of the variable resistance transistor follows the gate voltage of the PMOS power transistor, the equivalent resistance of the variable resistance transistor follows the output current variation of the PMOS power transistor. Consequently, the frequency domain pole at the output of the PMOS LDO regulator 212 can be canceled and the PMOS LDO regulator 212 is stable. In this embodiment, the PMOS LDO regulator 212 may further include a capacitor connected in parallel with the variable resistance transistor. For example, the capacitor is connected to a gate terminal of the variable resistance transistor and to a drain terminal or a source terminal of the variable resistance transistor. In the frequency domain, the variable resistance transistor and the parallel connected capacitor create a zero output, which can track the movement of the pole in the frequency domain and cancel the pole in the frequency domain, regardless of the gate voltage. In one embodiment, the PMOS LDO regulator 212 further includes an amplifier configured to receive the input voltage of the voltage regulator 206 and a current source that is connected to the amplifier and to ground. The PMOS LDO regulator 212 may further include a resistive voltage divider and an output capacitor that are connected to the PMOS power transistor and to ground.

The charge pump 214 is used to provide power to the NMOS LDO regulator 216. In an embodiment, the charge pump 214 is implemented as a one-stage charge pump in which the amplified voltage is double the regulated voltage, to minimize the switching loss. In one embodiment, the charge pump 214 is an open-loop charge pump having no feedback loop to feed the amplified voltage back into the charge pump 214. Compared to feedback based charge pumps, an open-loop charge pump can be implemented with a lower cost.

The NMOS LDO regulator 216 is used to generate a regulated output voltage for an analog circuit and/or a digital circuit. In an embodiment, the NMOS LDO regulator includes an operational amplifier (OPAMP) configured to receive an amplified voltage from the charge pump 214 and an NMOS power transistor having a gate terminal that is connected to the OPAMP. In this embodiment, the output voltage of the voltage regulator 206 is output from the NMOS power transistor. Because the OPAMP is powered by the charge pump 214 and the gate terminal of the NMOS power transistor is connected to the OPAMP, the gate voltage of the NMOS power transistor can be set higher than the output voltage of the NMOS power transistor plus the threshold voltage of the NMOS power transistor. Consequently, a low or zero dropout voltage is achieved for the NMOS LDO regulator 216. The NMOS LDO regulator 216 may further include a capacitor connected to the gate terminal of the NMOS power transistor and to ground, which is used to improve the stability of the NMOS LDO regulator 216. In an embodiment, the NMOS power transistor receives a power supply voltage at a drain terminal of the NMOS power transistor. In some embodiments, the NMOS LDO regulator 216 can supply regulated voltages to a digital load circuit and to an analog load circuit simultaneously. For example, an NMOS replica structure is used to avoid the need for an additional OPAMP. In an embodiment, the NMOS LDO regulator 216 includes a first NMOS power transistor having a gate terminal that is connected to the OPAMP and a second NMOS power transistor having a gate terminal that is connected to the OPAMP and the gate terminal of the first NMOS power transistor. A first output voltage is output from the first NMOS power transistor to, for example, an analog circuit, and a second output voltage is output from the second NMOS power transistor to, for example, a digital circuit.

Figure 3:
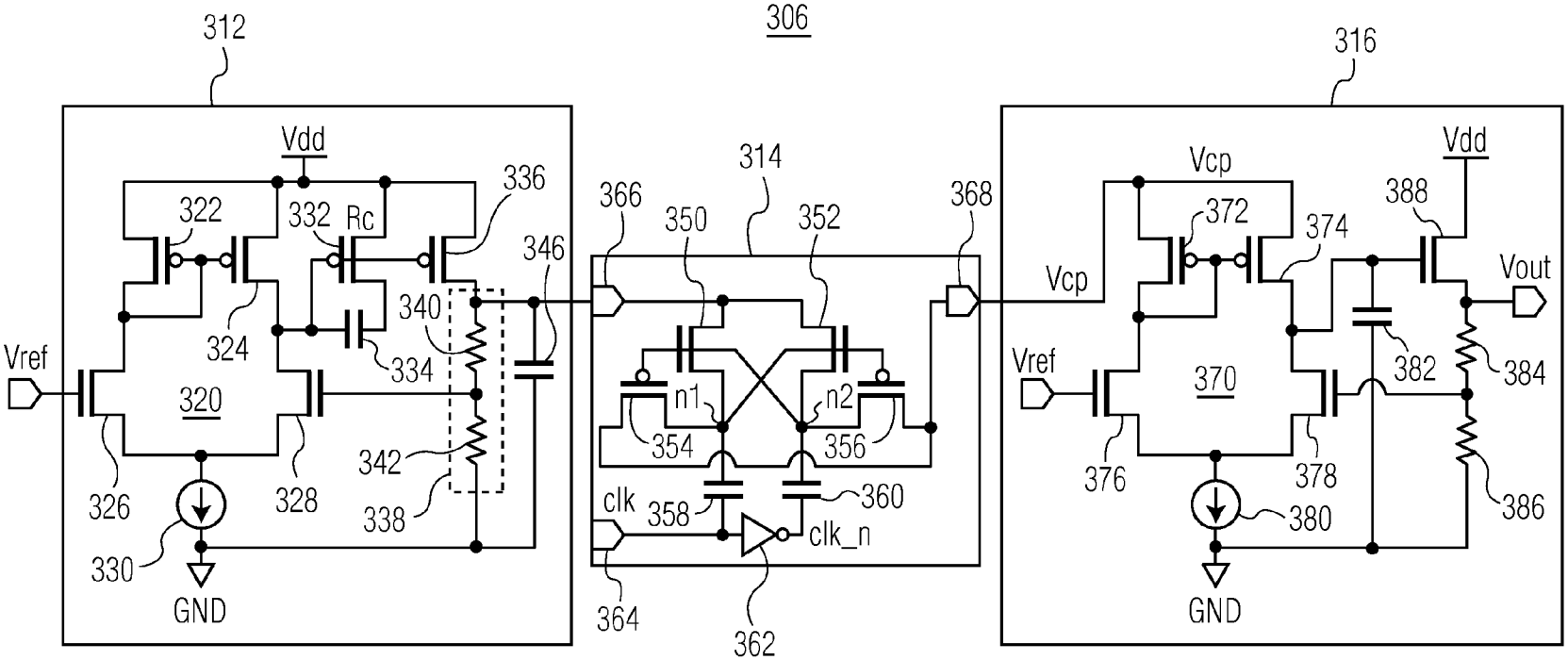
FIG. 3 depicts an embodiment of the voltage regulator shown in FIG. 2.

FIG. 3 depicts an embodiment of the voltage regulator 206 depicted in FIG. 2. In the embodiment depicted in FIG. 3, a linear voltage regulator 306 includes a PMOS LDO regulator 312 from which an input voltage, "Vref," is received, for example, from a voltage reference circuit, a one-stage charge pump 314, and an NMOS LDO regulator 316 from which an output voltage, "Vout," is provided. The PMOS LDO regulator 312 and the NMOS LDO regulator 316 are connected to a power supply voltage, "Vdd," and to ground. Compared to conventional NMOS or PMOS based voltage regulators, the voltage regulator 306 consumes less current, generates a low dropout voltage for the regulation of digital circuits, and achieves a high PSR ratio for the regulation of analog circuits. In one embodiment, the voltage regulator 306 achieves a current consumption of around 6 μA, generates a zero dropout voltage for digital circuit regulation, and has a PSR ratio of more than −40 dB for analog circuit regulation. For example, the current consumption of the PMOS LDO regulator 312 is around 2.2 μA, the current consumption of the charge pump 314 is around 1.6 μA, and the current consumption of the NMOS LDO regulator 316 is around 2.2 μA.

The PMOS LDO regulator 312 includes an error amplifier 320 that is formed by PMOS transistors 322, 324 and NMOS transistors 326, 328, a current source 330, a variable resistance transistor 332, a capacitor 334 connected in parallel with the variable resistance transistor 332, a PMOS power transistor 336, a resistive voltage divider 338 that is formed by resistors 340, 342, and an output capacitor 346.

The PMOS LDO regulator 312 is stable because the dominant pole at the frequency domain is at the gate terminal of the PMOS power transistor 336. The variable resistance transistor 332 works as a gate voltage controlled variable resistance, "Rc." In the embodiment depicted in FIG. 3, the variable resistance transistor 332 works in a linear region in which the gate-source voltage difference, "Vgs," of the transistor 332 is larger than the threshold voltage, "Vth," of the transistor 332 and the drain-source voltage difference, "Vds," of the transistor 332 is smaller than the voltage difference, "Vgs−Vth," between the gate-source voltage, Vgs, and the threshold voltage, Vth. The variable resistance transistor 332 is critical for the stability of the PMOS LDO regulator 312. In particular, in the frequency domain, the variable resistance transistor 332 and the parallel connected capacitor 334 create a zero at the output of the error amplifier 320. The frequency of that zero output in the frequency domain satisfies:

$$f = \frac{1}{R_C \times C_c}, \tag{1}$$

where "Rc" represents the equivalent resistance of the variable resistance transistor 332 and "Cc" represents the capacitance of the capacitor 334. Because the gate voltage of the variable resistance transistor 332 follows the gate voltage of the PMOS power transistor, the equivalent resistance, Rc, of the variable resistance transistor 332 follows the output current variation of the PMOS power transistor. Consequently, the zero output in the frequency domain can be used to cancel the frequency domain pole at the output of the PMOS LDO regulator 312. In particular, the frequency domain pole at the output of the PMOS LDO regulator 312 depends on the output impedance of the PMOS power transistor and the output capacitor 346. Because the output impedance of the PMOS power transistor is controlled by its gate voltage, the trajectory of the pole depends on the gate voltage. Because the resistance, Rc, of the variable resistance transistor 332 is also controlled by the same gate voltage as the PMOS power transistor, the zero output can track the move of the pole in the frequency domain and can cancel the pole, regardless of the gate voltage.

The PMOS LDO regulator 312 can achieve a low dropout voltage for the charge pump 314. In one embodiment, the voltage, Vdd, is set to 1.7V, the regulated voltage is 1.5V, and the voltage drop across the PMOS LDO regulator 312 is 0.2V. In addition, the PMOS LDO regulator 312 can achieve a low current consumption. The bias current of the OPAMP 320 is controlled by the current source 330. In an embodiment, the current of the current source 330 is set to 180 nanoamperes (nA) such that the overall current consumption of the PMOS LDO regulator 312 is around 2.2 microamperes (μA).

The charge pump 314 includes NMOS transistors 350, 352, PMOS transistors 354, 356, capacitors 358, 360, and an inverter 362. The charge pump 314 is used to provide power to the NMOS LDO regulator 316. In one embodiment, the charge pump 314 is an open-loop charge pump that does not have a feedback loop to stabilize its output. Compared to feedback based charge pumps, an open-loop charge pump can be implemented with a lower cost. In the embodiment depicted in FIG. 3, the charge pump 314 has only one amplifying stage to minimize the switching loss. Each amplifying stage can amplify the magnitude of an input voltage into an output voltage that has a magnitude that is two times the magnitude of the input voltage. The dimension of the charge pump 314 can be minimized by choosing the length of transistor to be the minimum channel length allowed by the process technology. In an embodiment, the input clock of the charge pump 314 is chosen to be lower than a predefined clock threshold to lower the switching loss. For example, the input clock of the charge pump 314 can be set to 1 MHz, which is made possible by the low loading current of 0.2 μA of the PMOS LDO regulator 312. In one embodiment, the current spike generated by the charge pump 314 is up to 400 μA.

In an example of an operation of the charge pump 314, the initial voltage at node, "n1," is 1.5V, and the initial voltage at node, "n2," is 3.0V. The voltage of the clock signal, "clk," which is input into a clock input terminal 364, continuously switches between 0V and 1.5V. When the voltage of the clock signal, clk, is at 0V, the transistor 350 is turned on because of the voltage at node, n2. After the transistor 350 is turned on, the voltage at the input terminal 366 is set to the voltage at node, n1, which is 1.5V, and the capacitor 358 is charged to the voltage at node, n1, which sets the voltage of the signal of the inverter 362, "clk_n," to the voltage at node, n1. Because the voltage at node, n1, is 1.5V, and the voltage at node, n2, is 3V, the transistor 356 is turned on and the capacitor 360 is discharged, setting the output voltage at the output terminal 368 of the charge pump 314, "Vcp," to 3V, which is two times the input voltage of the charge pump 314. When the voltage of the clock signal, clk, is at 1.5V, the charge on the capacitor 358 doesn't change and the voltage at node, n1, jumps from 1.5V to 3V, which causes the voltage at node, n2, to decrease from 3V to 1.5V and the voltage of the signal, clk_n, to decrease to 0V. Because the voltage at node, n1, is 3V, and the voltage at node, n2, is 1.5V, the transistor 354 is turned on and the capacitor 358 is discharged, setting the output voltage at the output terminal 368 of the charge pump 314, Vcp, to 3V. As the clock signal, clk, continuously switches between 0V and 1.5V, the output voltage of the charge pump 314 stays at 3V, which doubles the input voltage of the charge pump 314. Although the input voltage and the output voltage of the charge pump 314 are set to 1.5V and 3V in the operation example, in other embodiments, the input voltage and the output voltage of the charge pump 314 can be set to other values.

The NMOS LDO regulator 316 includes an operational amplifier (OPAMP) 370 that includes PMOS transistors 372, 374, and NMOS transistors, 376, 378, a current source 380, a capacitor 382, resistors 384, 386, and an NMOS power transistor 388. The NMOS LDO regulator 316 has two input power supplies, which include the charge pump output voltage, Vcp, and the power supply, Vdd. The OPAMP 370 is powered by the charge pump 314 to make a high gate voltage of the NMOS power transistor 388 possible. In the embodiment depicted in FIG. 3, the input voltage, Vref, is also input into the OPAMP 370. The drain terminal of the NMOS power transistor is hooked up to the power supply, Vdd. Because the gate voltage of the NMOS power transistor can be much higher than the output voltage of the NMOS power transistor plus the threshold voltage of the NMOS power transistor, a low or zero dropout voltage is achieved for the NMOS power transistor. The NMOS LDO regulator 316 is scalable. The loading current of the NMOS LDO regulator 316 can be expanded with additional NMOS transistors in parallel without affecting the stability of the NMOS LDO regulator 316. In an embodiment, the NMOS LDO regulator 316 has 0.2 μA load current.

Because the capacitor 382 is located between the gate terminal of the NMOS power transistor 388 and ground, the dominant pole in the frequency domain is generated at a relatively low frequency and consequently, stability of the NMOS LDO regulator 316 is achieved. Because the OPAMP 370 is biased with a low current (e.g., 0.2 μA), the output impedance of the OPAMP, which is at the gate terminal of the NMOS power transistor, is relatively large. Combining the large output impedance with the capacitance of the capacitor 382 at the gate terminal of the NMOS power transistor, the dominant pole is at a low frequency, which not only guarantees stability, but also filters out noise at the output voltage of the charge pump 314, Vcp, and generates a noise-free gate voltage at the gate terminal of the NMOS power transistor. Consequently, a high PSR ratio, which is critical for sensitive analog blocks, can be achieved.

Figure 4:
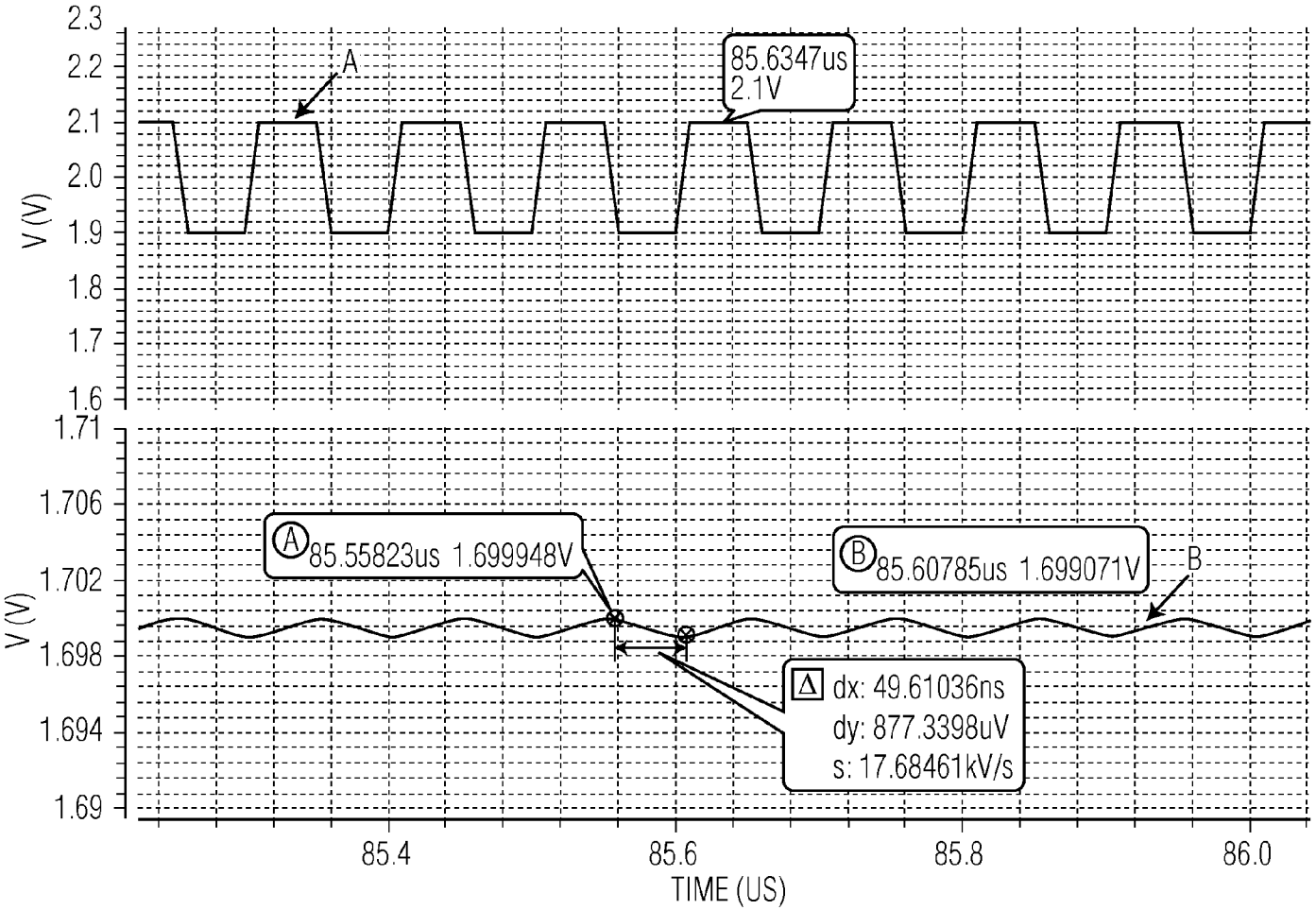
FIG. 4 is a diagram of an output voltage of the voltage regulator shown in FIG. 3.

In an embodiment, to measure the PSR ratio of the voltage regulator 306, the power supply, Vdd, is superimposed with noise. FIG. 4 is a diagram of an exemplary output voltage of the voltage regulator 306. In FIG. 4, the power supply, Vdd, is superimposed with peak-to-peak noise at 10 MHz and 200 mV. Specifically, curve "A" represents the imposed noise while curve "B" represents the output voltage of the voltage regulator 306. As indicated by curve B of FIG. 4, the noise (i.e., the ripples) of the output voltage, Vout, of the linear voltage regulator 306 is around 0.877 mV, which can be translated into a PSR ratio of around 47 dB, and can be used in the regulation of sensitive analog blocks. The PSR ratio is defined as AVdd/AVout. For a AVdd of 0.2V and a AVout of 0.877 mV, the PSR ratio is 228.05 or 47.16 dB, which can be expressed as "20*log 10(228.05)."

Figure 5:
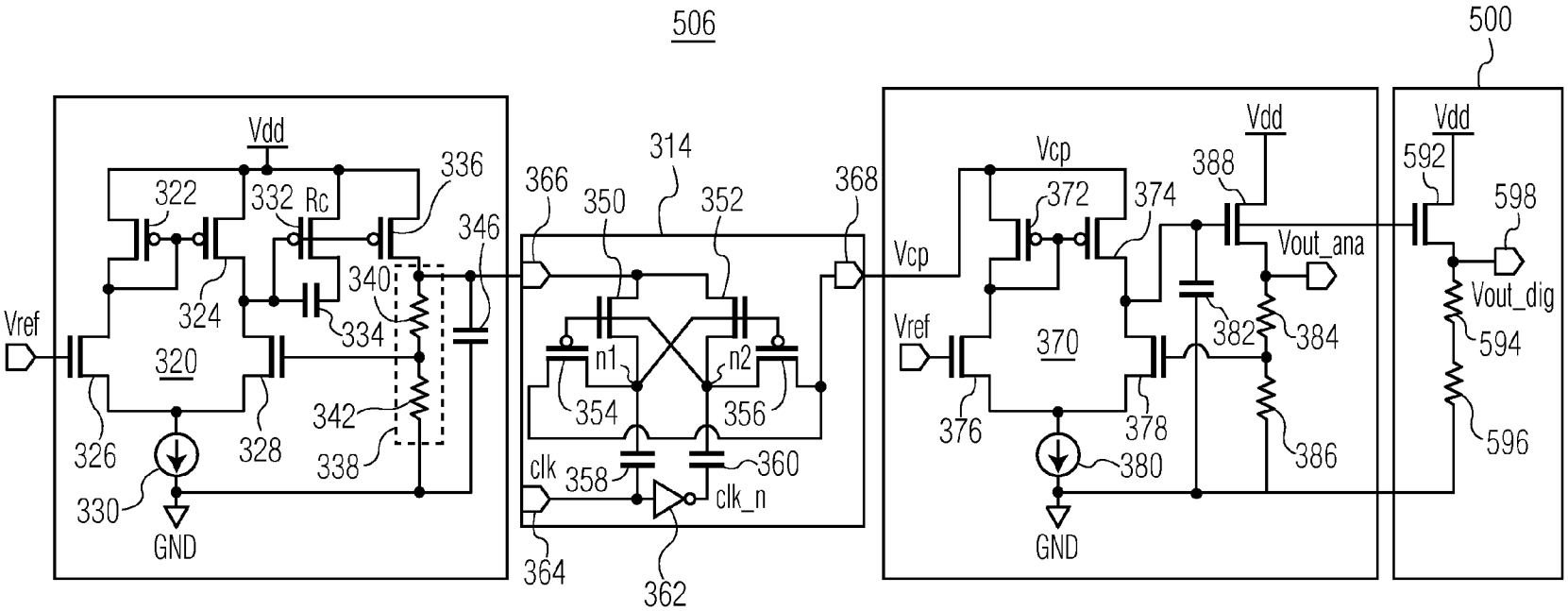
FIG. 5 depicts another embodiment of the voltage regulator shown in FIG. 2.

In some embodiments, the voltage regulator 306 can supply regulated voltage to a digital load circuit and to an analog load circuit simultaneously. An NMOS replica structure can be used to avoid the need for another OPAMP, in addition to the OPAMP 370. FIG. 5 depicts an embodiment of the voltage regulator 306 having an NMOS replica structure 500. In the voltage regulator 506 depicted in FIG. 5, the NMOS replica structure includes an NMOS power transistor 592, resistors 594, 596, and an output terminal 598 from which an output voltage, "Vout_dig," is output to a digital circuit. Compared with the voltage regulator 306 depicted in FIG. 3, the voltage regulator 506 depicted in FIG. 5 can simultaneously output a voltage, "Vout_ana," from an output terminal 590 to an analog circuit and output a voltage, "Vout_dig," from the output terminal 598 to a digital circuit. In the voltage regulator 506 depicted in FIG. 5, the value of the voltage, Vout_ana, is the same as the value of the voltage, Vout_dig. The voltage, Vout_ana, and the voltage, Vout_dig are separate to avoid coupling noise from the digital circuit into the analog circuit.

Although specific embodiments of the invention that have been described or depicted include several components described or depicted herein, other embodiments of the invention may include fewer or more components to implement less or more feature.

In addition, although specific embodiments of the invention have been described and depicted, the invention is not to be limited to the specific forms or arrangements of parts so described and depicted. The scope of the invention is to be defined by the claims appended hereto and their equivalents.

What is claimed is:

1. A linear voltage regulator comprising:

a PMOS low drop-out (LDO) regulator configured to convert an input voltage to a regulated voltage;

a charge pump connected to the PMOS LDO regulator and configured to amplify the regulated voltage into an amplified voltage; and an NMOS LDO regulator connected to the charge pump and configured to convert the amplified voltage into an output voltage.

2. The linear voltage regulator of claim 1, wherein the PMOS LDO regulator includes:

a PMOS power transistor from which the regulated voltage is output to the charge pump; and a variable resistance transistor having a gate terminal that is connected to a gate terminal of the PMOS power transistor.

3. The linear voltage regulator of claim 2, wherein the PMOS LDO regulator further includes a capacitor connected to the variable resistance transistor.

4. The linear voltage regulator of claim 3, wherein the capacitor is connected to a gate terminal of the variable resistance transistor and to a drain terminal or a source terminal of the variable resistance transistor.

5. The linear voltage regulator of claim 2, wherein the variable resistance transistor has a resistance that is controlled by a voltage at the gate terminal of the variable resistance transistor.

6. The linear voltage regulator of claim 2, wherein the PMOS LDO regulator further includes:

an amplifier configured to receive the input voltage; and a current source that is connected to the amplifier and ground.

7. The linear voltage regulator of claim 6, wherein the amplifier includes PMOS transistors and NMOS transistors.

8. The linear voltage regulator of claim 6, wherein the PMOS LDO regulator further includes a resistive voltage divider and an output capacitor that are connected to the PMOS power transistor and the ground.

9. The linear voltage regulator of claim 1, wherein the charge pump is a one-stage charge pump in which the amplified voltage is double the regulated voltage.

10. The linear voltage regulator of claim 1, wherein the charge pump has no feedback loop that feeds the amplified voltage back into the charge pump.

11. The linear voltage regulator of claim 1, wherein the NMOS LDO regulator includes:

an operational amplifier (OPAMP) configured to receive the amplified voltage; and an NMOS power transistor having a gate terminal that is connected to the OPAMP, wherein the output voltage is output from the NMOS power transistor.

12. The linear voltage regulator of claim 11, wherein the NMOS LDO regulator further includes a capacitor that is connected to the gate terminal of the NMOS power transistor and to ground.

13. The linear voltage regulator of claim 11, wherein the OPAMP is further configured to receive the input voltage of the linear voltage regulator.

14. The linear voltage regulator of claim 11, wherein the NMOS power transistor is configured to receive a power supply voltage at a drain terminal of the NMOS power transistor.

15. The linear voltage regulator of claim 1, wherein the NMOS LDO regulator includes:

an operational amplifier (OPAMP) configured to receive the amplified voltage;

a first NMOS power transistor having a gate terminal that is connected to the OPAMP, wherein the output voltage is output from the first NMOS power transistor; and a second NMOS power transistor having a gate terminal that is connected to the OPAMP and the gate terminal of the first NMOS power transistor, wherein a second output voltage is output from the second NMOS power transistor.

16. A linear voltage regulator comprising:

a PMOS low drop-out (LDO) regulator configured to convert an input voltage to a regulated voltage;

an one-stage charge pump connected to the PMOS LDO regulator and configured to amplify the regulated voltage into an amplified voltage that doubles the regulated voltage; and an NMOS LDO regulator connected to the one-stage charge pump and configured to convert the amplified voltage into an output voltage, wherein the PMOS LDO regulator includes:

a PMOS power transistor from which the regulated voltage is output to the one-stage charge pump; and a variable resistance transistor having a gate terminal that is connected to a gate terminal of the PMOS power transistor, and wherein the NMOS LDO regulator includes:

an operational amplifier (OPAMP) configured to receive the amplified voltage; and an NMOS power transistor having a gate terminal that is connected to the OPAMP, wherein the output voltage is output from the NMOS power transistor.

17. The linear voltage regulator of claim 16, wherein the PMOS LDO regulator further includes a capacitor that is connected to a gate terminal of the variable resistance transistor and to a drain terminal or a source terminal of the variable resistance transistor, and wherein the variable resistance transistor has a resistance that is controlled by a voltage at the gate terminal of the variable resistance transistor.

18. The linear voltage regulator of claim 17, wherein the PMOS LDO regulator further includes:

an amplifier configured to receive the input voltage, wherein the amplifier includes PMOS transistors and NMOS transistors;

a current source that is connected to the amplifier and ground; and a resistive voltage divider and an output capacitor that are connected to the PMOS power transistor and the ground.

19. The linear voltage regulator of claim 16, wherein the NMOS LDO regulator further includes a capacitor that is connected to the gate terminal of the NMOS power transistor and to ground.

20. A linear voltage regulator comprising:

a PMOS low drop-out (LDO) regulator configured to convert an input voltage to a regulated voltage;

a charge pump connected to the PMOS LDO regulator and configured to amplify the regulated voltage into an amplified voltage; and an NMOS LDO regulator connected to the charge pump and configured to convert the amplified voltage into a first output voltage and a second output voltage, wherein the PMOS LDO regulator includes:

a PMOS power transistor from which the regulated voltage is output to the charge pump;

a variable resistance transistor having a gate terminal that is connected to a gate terminal of the PMOS power transistor; and a capacitor connected in parallel with the variable resistance transistor, and wherein the NMOS LDO regulator includes:

an operational amplifier (OPAMP) configured to receive the amplified voltage;

a first NMOS power transistor having a gate terminal that is connected to the OPAMP, wherein the first output voltage is output from the first NMOS power transistor; and a second NMOS power transistor having a gate terminal that is connected to the OPAMP and the gate terminal of the first NMOS power transistor, wherein the second output voltage is output from the second NMOS power transistor.

* * * * *